US007500554B2

(12) United States Patent
Schererz et al.

(10) Patent No.: US 7,500,554 B2
(45) Date of Patent: Mar. 10, 2009

(54) DEVICE FOR CONVEYING FLAT POSTAL ARTICLES IN AN UPRIGHT POSITION

(75) Inventors: Holger Schererz, Rehfelde (DE); André Tolksdorf, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 238 days.

(21) Appl. No.: 11/587,717

(22) PCT Filed: Apr. 20, 2005

(86) PCT No.: PCT/EP2005/004215

§ 371 (c)(1),
(2), (4) Date: Oct. 27, 2006

(87) PCT Pub. No.: WO2005/108256

PCT Pub. Date: Nov. 17, 2005

(65) Prior Publication Data

US 2008/0041698 A1 Feb. 21, 2008

(30) Foreign Application Priority Data

May 3, 2004 (DE) ..... 10 2004 022 027

(51) Int. Cl.
*B65G 15/10* (2006.01)

(52) U.S. Cl. ..... 198/817; 198/626.1; 198/626.3; 198/626.6

(58) Field of Classification Search ..... 271/3.22, 271/3.24, 6, 4.06, 10.06; 198/463.3, 620, 198/626.1, 626.5, 626.6
See application file for complete search history.

(56) References Cited

U.S. PATENT DOCUMENTS 5,188,210 A 2/1993 Malow
2003/0137101 A1 7/2003 Hendzel

FOREIGN PATENT DOCUMENTS

EP 1 154 944 A1 11/2001

(Continued)

OTHER PUBLICATIONS

Derwent Abstract—FR-2 692 565; Dec. 24, 1993; Compagne Generale D'Automatisme CGA-HBS Société Anonyme, France.

*Primary Examiner*—John Q. Nguyen
*Assistant Examiner*—Yolanda Cumbess
(74) *Attorney, Agent, or Firm*—Laurence A. Greenberg; Werner H. Stemer; Ralph E. Locher

(57) ABSTRACT

An apparatus for conveying mail flats in an upright position with at least one conveying module has a circulating, horizontally oriented floor belt guided via return rollers, and two endless lateral guide belts guided via deflection rollers. A distance of the lateral guide belts from one another at ends of the conveying modules is greater than a thickest mail item. A height of a first lateral guide belt is less than that of a second lateral guide belt. Below the first lateral guide belt an elastic, narrow, endless pressure belt is provided, which is resiliently pressed against a lower part of the second lateral guide belt by pressure deflection rollers and pressed away from the second lateral guide belt by the mail items according to their thickness. Guide rails are mounted obliquely to a conveying direction and tangentially to the pressure deflection rollers.

7 Claims, 5 Drawing Sheets

FOREIGN PATENT DOCUMENTS

| | | | |
|---|---|---|---|
| EP | 1 200 326 | B1 | 10/2003 |
| EP | 1 154 944 | B1 | 3/2004 |
| FR | 1 033 503 | | 7/1953 |
| FR | 2 692 565 | | 12/1993 |
| WO | WO 93/02811 | A1 | 2/1993 |
| WO | WO 00/78471 | A1 | 12/2000 |

DEVICE FOR CONVEYING FLAT POSTAL ARTICLES IN AN UPRIGHT POSITION

BACKGROUND OF THE INVENTION

The invention relates to an apparatus for conveying mail flats in an upright position.

In mail processing machines it is necessary to convey flat items past process equipment to various end points. The selection of suitable conveying principles is determined by required throughputs, required conveying speed, formats of the items to be conveyed and permissible gaps, mainly dictated by process equipment, between two consecutive items to be conveyed.

Known systems for conveying in a vertical orientation are mainly designed for specifically classified format ranges. In machines for primarily standard letter processing these are mainly pinch-belt systems in which flats up to approx. 10 mm thick are conveyed upright, clamped between two flat belts. Aside from the thickness, a format limitation of such systems is a necessary minimum flexibility which an item must exhibit for it to be conveyed successfully.

For larger and thicker formats and items having very low bendability, such systems can only be deployed using very large gaps and lower speeds.

SUMMARY OF THE INVENTION

Other known systems for corresponding flat mail items, such as U-channel systems (EP 0 444 177 B1), again only fulfill to a limited extent the requirement of also conveying limp items in a required quality and in particular of feeding them to the process equipment in a defined manner.

The U-channel system with moving floor and lateral belts consists of conveying channels having the width of the thickest mail item, the items being transported securely without any relative movement with respect to one another. However, exceptionally thin, limp items may collapse in the up to 50 mm wide channels and, in this state, can no longer be righted in order to be presented full-face to a scanner, for example.

Yet other solutions (WO 00/78 471 A1) consist of conveying systems with special pressure rollers (lamellar rollers), which, disposed above mail item height, ensure conveyance of different mail items. Particularly in the case of a large format range, this is expensive because of the number of rollers then necessary. Moreover, each roller possesses its own inertia which, in the case of different item thicknesses and consequently differing effective radius of the roller, must be accelerated differently and, without greater outlay, only allows inadequate access for maintenance and repairs. Such systems exist in vertical, completely covered (height of the mail items) as well as inclined, partially covered disposition of the pressure belts or rollers.

Also known are devices (EP 1 200 326 B1, EP 1 154 944 B1) whereby mail items are conveyed between a lateral guide belt and guides disposed at distance from same and are pressed against the lateral guide belt in their lower region by means of a resiliently guided pressure belt.

The object of the invention is to create a reliable apparatus for conveying mail flats in different formats in an upright position with the least possible slippage of the items relative to one another and to the conveying direction, which feeds the items in a defined position to process equipment.

This object is achieved by an apparatus for conveying mail flats in an upright position, wherein the distance of the lateral guide belts from one another at the module ends is greater than the thickest item to be transported. The height of the first lateral guide belt is made less than that of the second lateral guide belt. Below the first guide belt there is disposed a elastic, narrow, endless belt which is pressed resiliently against the lower part of the second guide belt by means of pressure deflection rollers and pressed away from the second guide belt by the mail items according to their thickness. Mounted on the supports of the pressure deflection rollers are mail-item-impact-absorbing, low-friction guide rails running obliquely to the conveying direction and tangentially to the pressure deflection rollers. This not only ensures that the thick items are conveyed in a non-damaging manner but also that the items with low intrinsic stiffness are transported in a securely gripped manner preventing them from collapsing.

Advantageous embodiments of the invention are set forth in the sub-claims.

It is advantageous here, in the entry section of the conveying module, to guide and deflect the pressure belt via three deflection rollers disposed at the vertices of a pivoted triangle. The pressure deflection roller which presses the pressure belt against the second guide belt, and the rear deflection roller are pivoted on swivel mounted lever arms at a pivot point where the third deflection roller located farthest forward in the conveying direction is fulcrumed. The pressure deflection roller with the pressure belt is pressed away from the second guide belt by an incoming mail item according to the item thickness against a force. This force is produced merely by the corresponding displacement of the pressure belt passing over the rear deflection roller against a tension roller of the entry section without an additional spring element.

For the exit section of the conveying module it is advantageous to return the pressure belt via another pressure deflection roller which is pressed with the pressure belt against the deflection roller of the second guide belt in the exit section, and via a rear deflection roller of the exit section. These two deflection rollers are each pivotally mounted on a lever arm. The other ends of the two lever arms are mounted at a pivot point and in a diverging manner from same, which point is located upstream of the two deflection rollers approximately centrally between same, the belt tension likewise being used to produce the pressure force.

To reduce the impact loading of the mail items and pressure belt mechanisms it is advantageous to mount the guide rails on the lever arms of the pressure rollers of the pressure belt by means of vibration damping elements.

A particularly non-damaging conveyance of the mail items is achieved if, in the entry and exit section, a lever arm is connected in each case to an actuator which temporarily moves the relevant pressure deflection roller away from the second guide belt according to the measured thickness, position and length of the mail item as long as said item is located at the pressure deflection roller.

It is also advantageous to provide the second lateral guide belt and also the floor belt on the conveying side with a high coefficient of friction with respect to the mail item. This reduces the risk of slippage of the items relative to the conveying channel.

To ensure that process equipment within the transport module has free access to the mail item surfaces and that the items assume a defined position in front of said process equipment, it is advantageous if the second lateral guide belt is subdivided into two sub-belts at the process equipment by means of additional deflection rollers and if there is disposed upstream of the process equipment a pressure roller which presses the first lateral guide belt and the pressure belt against the second lateral guide belt.

The invention will now be explained in greater detail using an example with reference to the accompanying drawings, in which:

DETAILED DESCRIPTION OF THE INVENTION

Figure 1:
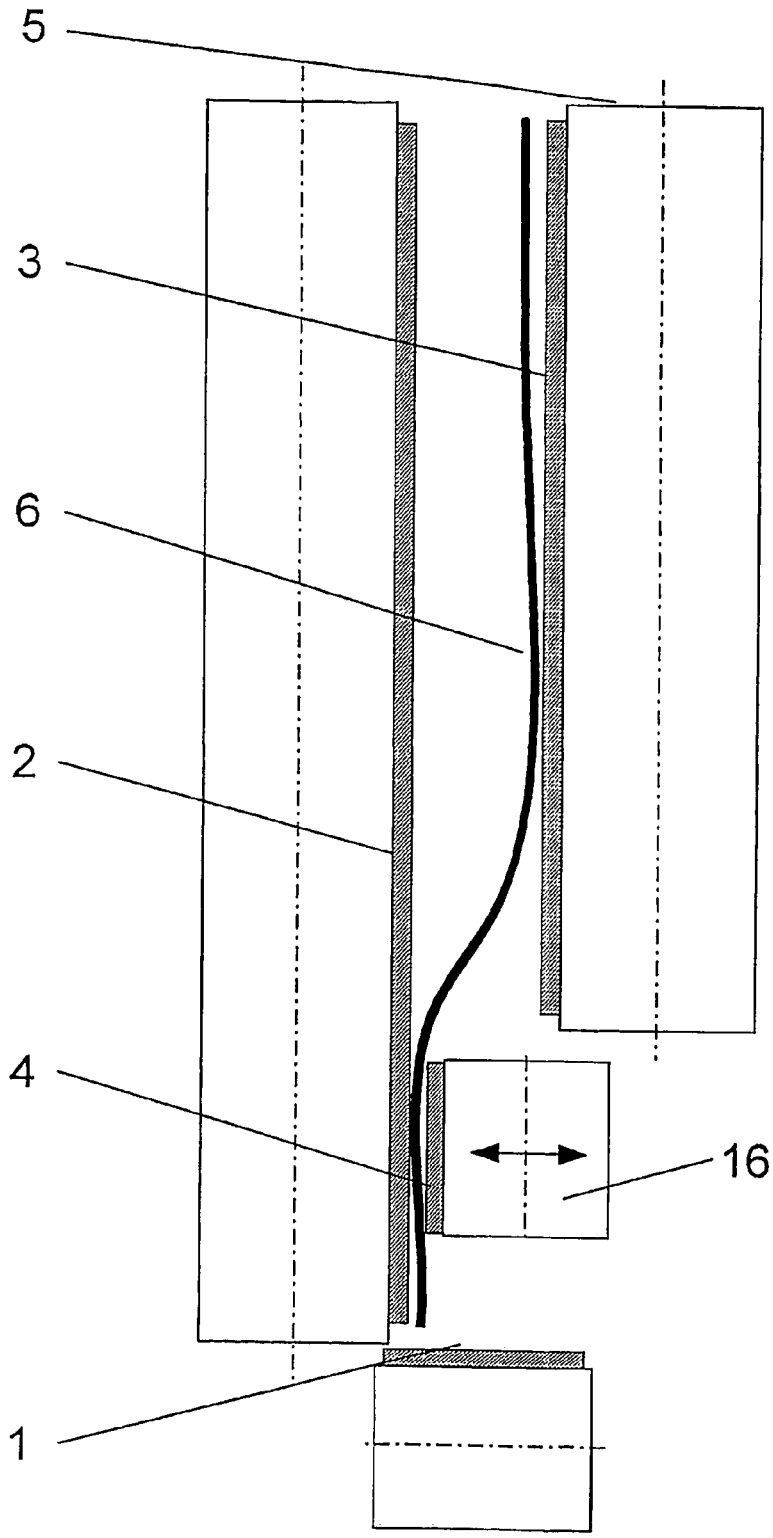
FIG. 1 shows a schematic sectional view of the exit section of a conveying module.

As shown in FIG. 1, the conveying apparatus which is subdivided into sub-sections/conveying modules has a floor belt 1, a high second lateral guide belt 2 and an upper first lateral guide belt 3 which is only pressed-in in parts and in some cases incompletely in the central longitudinal region. The distance perpendicular to the conveying direction of the fixed deflection rollers 5 of the upper first lateral guide belt 3 and of the second lateral guide belt 2 is greater than the maximum thickness of the mail items 6 to be transported.

In addition, a narrow pressure belt 4 is disposed below the guide belt. The floor belt 1, the second lateral guide belt 2, the upper first lateral guide belt 3 and the lower narrow pressure belt 4 form a U-channel similar to the known solution. By means of a special rocker combination at the entrance and exit of a belt group, the lower narrow pressure belt 4 is disposed in such a way that it passively avoids thicker mail items 6 without negative effect (conveying slippage), orientating them to the second guide belt 2. For thinner and in particular limp mail items 6, the use of the lower pressure belt 4 ensures that these items 6 are supported in the lower region. Collapsing of these critical formats is prevented and, by means of the clamping between second guide belt 2 and pressure belt 4, such a stable position of the mail items is achieved that these items 6 can be righted as required before process equipment using an (in part) pressed-in first lateral guide belt 3. The second lateral guide belt 2 here assumes the function of a guide element which, however, imparts no relative movement to the mail item 6.

This provides optimum conveying for the mail items 6 with a large range of thicknesses. Moreover, it is particularly suitable for feeding to process equipment (scanners, etc.).

The length of the conveying modules is determined solely by the required function and not according to gaps between mail items 6. The gaps only determine the arrangement of additional pressure rollers 7 which press the first lateral guide belt 3 and the pressure belt 4 against the second lateral guide belt 2. The number and spacing of the additional pressure rollers 7 is governed by the distance with which a maximally thick mail item 6 can follow a maximally thin item 6 without the lower pressure belt 4 being affected in such as way that the supporting function for thin, limp items 6 is relinquished. To ensure that process equipment within the transport module has free access to the mail item surfaces and that the items 6 assume a defined position in front of the process equipment, the second lateral guide belt 2 is subdivided into two sub-belts at the process equipment by means of additional deflection rollers and there is disposed upstream of the process equipment a additional pressure roller 7 which presses the first lateral guide belt 3 and the pressure belt 4 against the second lateral guide belt 2.

Figure 2:
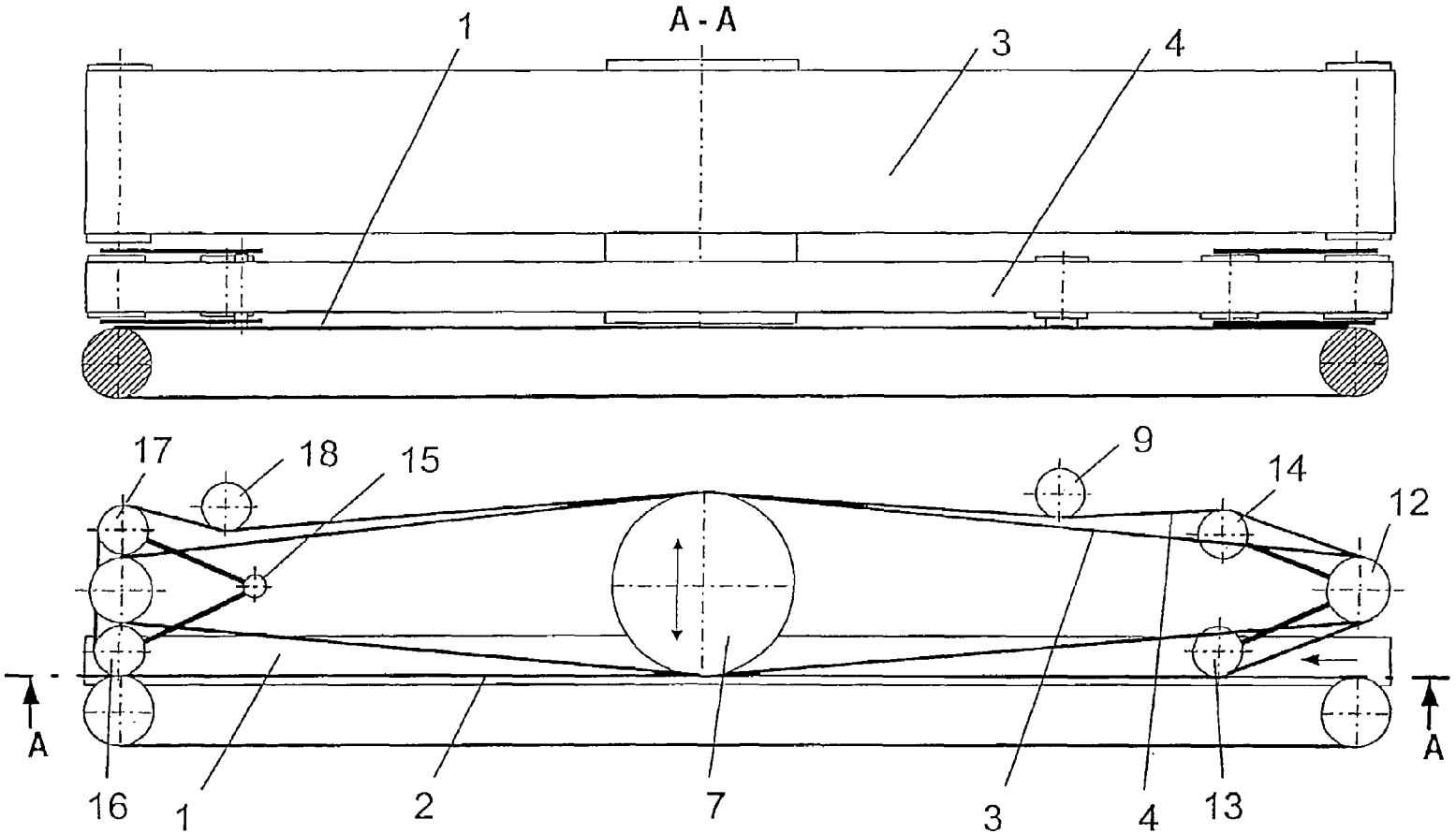
FIG. 2 shows a schematic plan view and an associated sectional view of a conveying module.
Figure 3:
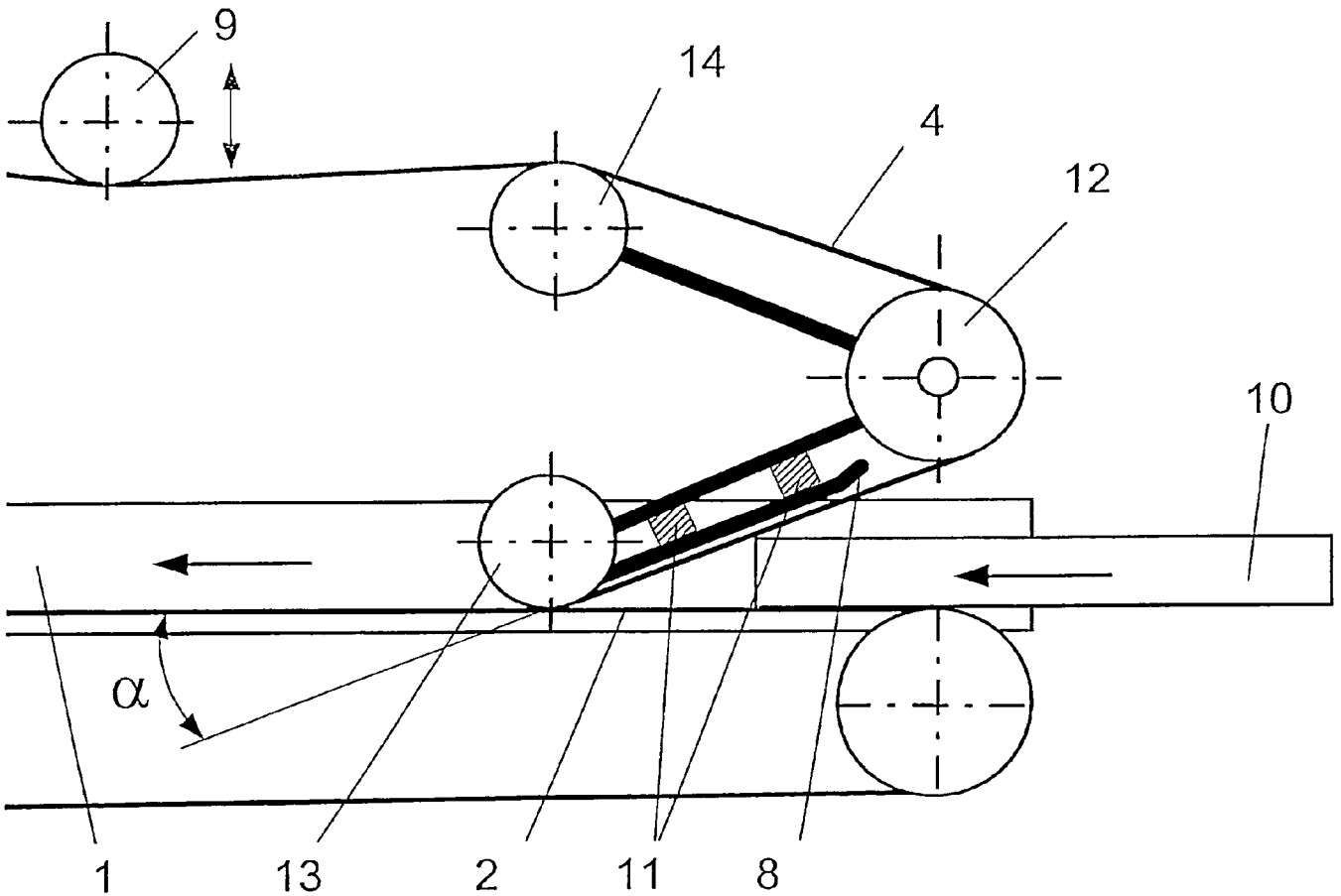
FIG. 3 shows a plan view of the entry section of a conveying module.

As shown in FIG. 2 and FIG. 3 there is located at the entrance of the conveying module an entry rocker consisting of three deflection rollers 12,13,14, disposed at the vertices of a pivoted triangle via which the pressure belt 4 is guided and deflected. The pressure deflection roller 13 which presses the pressure belt 4 against the second guide belt 2, and the rear deflection roller 14 are pivoted on swivel mounted lever arms at a pivot point where the third deflection roller 12 located farthest forward in the conveying direction is fulcrumed. Guide rails 8 are mounted on the lever arm of the pressure deflection roller 13 by means of vibration damping elements 11, thereby damping the opening impact of the rocker particularly for thick mail items 10 with low intrinsic damping (high hardness). The pressure deflection roller 13 with the pressure belt 4 and the guide rail 8 is pressed by an incoming mail item 10 according to the item thickness away from the second guide belt 2 against a force. This adjustable force is produced merely by the corresponding displacement of the pressure belt 4 passing over the rear deflection roller 14 against a tension roller 9 of the entry section without an additional spring element. The entry rocker has a low moment of inertia for the purposes of low conveying slippage and minimal contact pressure on the mail item 6,10. The triangular shape ensures that the entry angle ($\alpha$) and therefore the difference between the velocity components of the pressure belt 4 in the conveying direction are kept low. The coefficients of friction of the pressure belt 4 running over the guide rail 8 must be selected low on both sides, because when thick incoming mail items 6,10 are encountered, the friction between pressure belt 4 and guide rail 8 is temporarily imparted to the pressure belt 4 as additional power. On the conveying side, low friction with respect to the mail item 6,10 is necessary, because the speed of an incoming mail item 10 as a function of the angle $\alpha$ is greater than that of the pressure belt 4 running at the angle $\alpha$. In the entry phase, this results in relative movement between mail item 10 and lower pressure belt 4.

In order to prevent this relative movement from translating into conveying slippage, the second lateral guide belt 2 on the conveying side and as far as possible also the floor belt 1 are provided with a high coefficient of friction with respect to the mail items 6,10.

Figure 4:
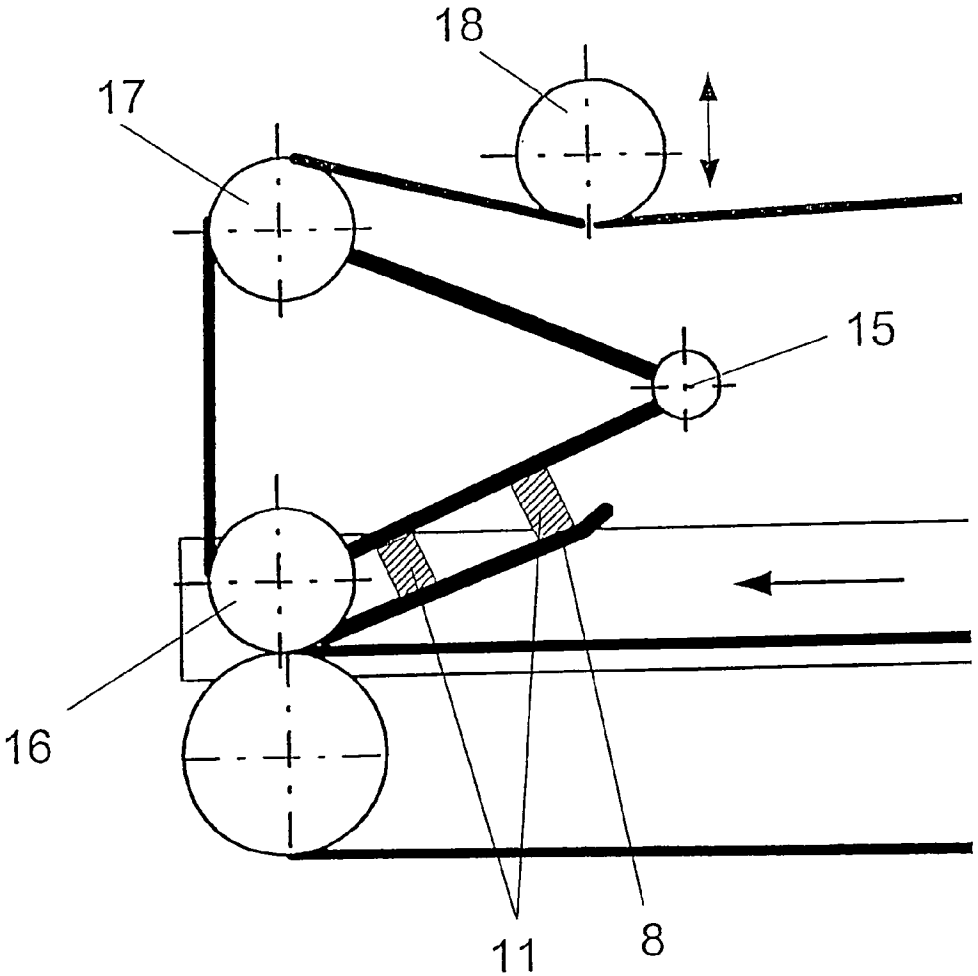
FIG. 4 shows a plan view of the exit section of a conveying module.

Similarly to the entry rocker, the exit rocker (FIG. 4) consists of a pivot point 15 at which two diverging lever arms are mounted, another pressure return roller 16 and a rear deflection roller 17 of the exit section, both of which are mounted on the free ends of the lever arms, as well as a displaceable tension roller 18 of the exit section. On the lever arm of the pressure return roller 16 there is likewise mounted a guide rail by means of damping elements.

Due to the virtually transverse-force-free effect of the belt tension forces, any required rocker force can once again be achieved by the tension roller 18 and suitable belt selection and the vibration characteristics adjusted.

Figure 5:
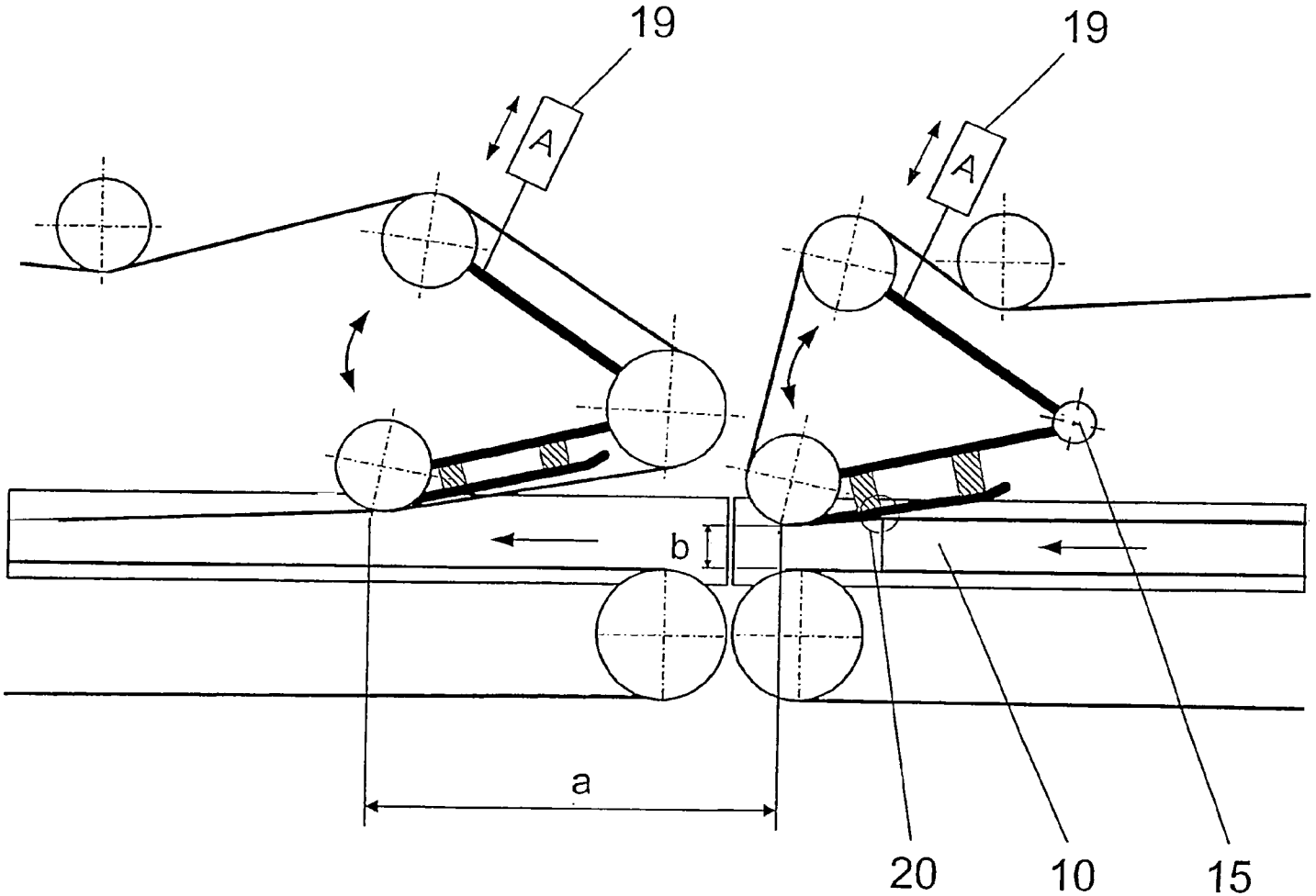
FIG. 5 shows a plan view of the adjacent sections of two conveying modules with active adjustment of the pressure belt.

As shown in FIG. 5, in the entry and exit section a lever arm is in each case connected to an actuator 19 which temporarily moves the relevant pressure deflection roller 13,16 away from the second guide belt 2 via the rocker according to the measured mail item thickness, position and length as long as the mail item 6,10 is located at the pressure deflection roller 13,16.

The invention claimed is:

1. An apparatus for conveying mail flats in an upright position with at least one conveying module comprising a circulating, horizontally oriented floor belt guided via return rollers, and two endless lateral guide belts guided via deflection rollers, wherein:

the distance of the lateral guide belts from one another at ends of the conveying modules is greater than a thickest mail item to be conveyed, the height of a first lateral guide belt is implemented less than that of the second lateral guide belt, below the first lateral guide belt there is disposed an elastic, narrow, endless pressure belt which is resiliently pressed against the lower part of the second lateral guide belt by means of pressure deflection rollers and pressed away from the second lateral guide belt by the mail items according to their thickness, and guide rails with a low coefficient of friction with respect to the mail items and which absorb impacts of the mail items at the pressure deflection rollers are mounted obliquely to the conveying direction and tangentially to the pressure deflection rollers and which.

2. The apparatus of claim 1, wherein in there is an entry section of the conveying module and wherein the pressure belt is guided and deflected via three deflection rollers disposed at vertices of a pivoted triangle, wherein the pressure deflection roller presses the pressure belt against the second lateral guide belt, and a rear deflection roller is pivoted on swivel mounted lever arms at a pivot point where a third deflection roller located farthest forward in the conveying direction is fulcrumed, wherein the pressure deflection roller with the pressure belt is pressed away from the second lateral guide belt by an incoming mail item according to the item thickness against a force which is produced by the corresponding displacement of the pressure belt passing over the rear deflection roller against a tension roller of the entry section.

3. The apparatus of claim 2, wherein in the entry and exit sections, the lever arm is connected in each case to an actuator which temporarily presses the pressure deflection rollers away from the second guide belt according to a measured mail item thickness, position and length as long as the mail item is located at the pressure deflection rollers.

4. The apparatus of claim 2, wherein the guide rails are mounted on the lever arms of the pressure rollers of the pressure belts by means of vibration-damping elements.

5. The apparatus of claim 1, wherein in there is an exit section of the conveying module wherein the pressure belt is returned via another pressure deflection roller which presses the pressure belt against the deflection roller of the second lateral guide belt in the exit section, and via a rear deflection roller of the exit section, wherein these two deflection rollers are each pivotally mounted on a lever arm, and other the ends of the two lever arms are mounted at a pivot point and in a diverging manner from same, which point is located upstream of the two deflection rollers and approximately centrally between same, and wherein the pressure deflection roller of the exit section is pressed away from the pressure belt by an outgoing mail item depending on its thickness by the second lateral guide belt against a force which is produced by the corresponding displacement of the pressure belt passing over the rear deflection roller against a tension roller of the exit section.

6. The apparatus of claim 1, wherein the second lateral guide belt and the floor belt are provided on the conveying side with a high coefficient of friction with respect to the mail item.

7. The apparatus of claim 1, wherein, the second lateral guide belt is subdividable within the conveying module by means of additional deflection rollers into two sub-belts, so that the process equipment has access to the mail item surfaces, and there is disposed upstream of the process equipment an additional pressure roller which presses the first lateral guide belt and the pressure belt against the second lateral guide belt.

* * * * *